US006187404B1

(12) United States Patent
Schumann

(10) Patent No.: US 6,187,404 B1
(45) **Date of Patent: *Feb. 13, 2001**

(54) HOLDING DEVICE

(75) Inventor: Jörn Schumann, Reinbek (DE)

(73) Assignee: Beiersdorf AG, Hamburg (DE)

( * ) Notice: Under 35 U.S.C. 154(b), the term of this patent shall be extended for 0 days.

This patent is subject to a terminal disclaimer.

(21) Appl. No.: 09/133,167

(22) Filed: Aug. 12, 1998

(30) Foreign Application Priority Data

Aug. 14, 1997 (DE) ..... 197 35 234

(51) Int. Cl.[7] ..... C09J 7/02

(52) U.S. Cl. ..... 428/40.1; 248/205.3; 248/467; 248/683; 428/41.8; 428/42.1; 428/68; 428/192; 428/194

(58) Field of Search ..... 428/40.1, 41.8, 428/42.1, 192, 194, 68; 248/683, 467, 205.3

(56) References Cited

U.S. PATENT DOCUMENTS 5,921,514 * 7/1999 Schumann ..... 248/205.3
5,928,747 * 7/1999 Luhmann ..... 428/40.1
5,984,247 * 11/1999 Luhmann ..... 248/205.3

* cited by examiner

*Primary Examiner*—Nasser Ahmad
(74) *Attorney, Agent, or Firm*—Norris McLaughlin & Marcus P.A.

(57) ABSTRACT

Holding device, comprising a one-part hook body and a one-part baseplate, the baseplate for the bond with an adhesive strip which releases on pulling being designed such that a grip tab of the adhesive strip protrudes beyond the baseplate, the hook body being designed such that it covers over the baseplate and also the grip tab protruding beyond the latter, characterized in that a) on the baseplate there are integrally formed at least four extensions, which b) respectively lie opposite one another in pairs and which c) protrude laterally beyond the baseplate, and in that in the hook body there are formed guides in which the extensions of the baseplate are guided such that a) the hook body is released by a movement parallel to the baseplate from the basic position, in which the hook body is anchored on the baseplate and thereby covers over the baseplate and the grip tab of the adhesive strip, and during this release lifts itself off the underlying surface, at least on one side, so that b) access to the grip tab is possible, c) the hook body and the baseplate are undetachably bonded to each other.

6 Claims, 9 Drawing Sheets

HOLDING DEVICE

The invention relates to a holding device which, by means of adhesive strips which release on pulling, is reversibly bondable and reusable, possibly with a new such adhesive strip.

BACKGROUND OF THE INVENTION

Adhesive strips which release on pulling are commercialized as "tesa Power-Strips" by Beiersdorf AG and are also described by numerous patents, such as DE 33 31 016 B1, DE 42 22 849 B1, DE 43 39 604 B1, DE 44 28 587 B1 and DE 44 31 914 B1. In addition, U.S. Pat. No. 4,024,312, WO92/11332, WO92/11333 and W095/06691 describe adhesive strips of this kind. Such adhesive strips are pulled out of the bond in the direction of the bond joint, in a way comparable with the opening of a preserving jar.

For instance, U.S. Pat. No. 4,024,312 describes a pressure-sensitive adhesive tape having extensible and elastic backing composed of a block copolymer, in particular for applications in the medical area, where painless pulling off the skin is desirable.

Furthermore, DE 33 31 016 A1 describes an adhesive film for re-releasable adhesive bonds which allows an adhesive bond established therewith to be released by pulling on the adhesive film in the direction of the bonding plane. With such adhesive films, high adhesive forces and shear strengths can be achieved and adhesive bonds can be released again without further aids, in a way comparable to the opening of a preserving jar, similar to the way in which there the rubber seal is pulled by the grip out of the seal joint.

Furthermore, DE 37 14 453 C1 describes a practice explosive charge which can be detached again from practice objects without destroying it and is reversibly fastened by such an adhesive film. WO 92/11333 also describes, inter alia, adhesive films for corresponding applications, the adhesive films used having a low elasticity with at the same time high extension.

DE 42 22 849 C1 likewise describes a strip of an adhesive film of this kind with a specially shaped grip tab.

In addition, hooks or similar fastening systems for use together with such adhesive strips are commercially available as "tesa Power-Strips mit Haken" [with hooks] or else "tesa Power-Strips Systemhaken" [system hooks] from Beiersdorf AG.

Finally, DE 42 33 872 C2, DE 195 11 288 B1 and WO 94/21157 describe re-releasable self-adhesive hooks which are likewise provided with such adhesive films and are also re-releasable.

However, the adhesive systems and hooks represented in the above-mentioned publications also have a number of disadvantages:

Problems with hooks and the like of the prior art are, on the one hand, the visual concealment of the grip tab, which for the subsequent pulling must protrude beyond the device, and, on the other hand, the protection of this grip tab against manipulation or damage, including in particular damage by UV light.

Also, a multi-part design, as disclosed by the prior art, is disadvantageous whenever one part is lost or falls down, for instance during assembly. This risk increases the smaller the hooks are in their dimensions.

The object of the invention was to remedy this situation and, in particular, to provide a hook or the like which does not have the disadvantages of the prior art, or at least not to the same extent.

SUMMARY OF THE INVENTION

The invention relates accordingly to a holding device, especially a hook, as characterized in detail in the claims. The embodiments according to the subclaims are preferred.

The holding device according to the invention comprises a one-part hook body and a one-part baseplate, which are undetachably bonded to each other, the baseplate for the bond with an adhesive strip which releases on pulling being designed such that a grip tab of the adhesive strip protrudes beyond the baseplate, and the hook body being designed such that it covers over the baseplate and also the grip tab protruding beyond the latter.

On the baseplate there are integrally formed at least four extensions, which respectively lie opposite one another in pairs and which protrude laterally beyond the baseplate.

In the hook body there are formed guides in which the extensions of the baseplate are guided such that the hook body is released by a movement parallel to the baseplate from the basic position, in which the hook body is anchored on the baseplate and thereby covers over the baseplate and the grip tab of the adhesive strip, and during this release lifts itself off the underlying surface, at least on one side, so that access to the grip tab is possible.

In a preferred embodiment, the extensions of the baseplate are arranged at the same height.

In a further preferred embodiment, the hook body is always aligned parallel to the baseplate during the movement parallel to the baseplate.

The hook body and/or the baseplate are preferably produced from metal or plastic, most preferably polyethylene terephthalate, polystyrene or ABS.

The hook body advantageously has a border which laterally encloses and visually conceals the baseplate and the adhesive strip to be adhesively attached behind the latter.

Finally, the holding device has an adhesive strip adhesively attached behind the baseplate.

With the aid of the holding device according to the invention, the disadvantages known from the prior art are avoided in an outstanding way.

No part of the holding device can be lost.

The hook body may also be used for grasping during the stripping operation.

Furthermore, a material mix is possible in the case of the hook body and baseplate, i.e. an optimum selection of the materials according to the application is possible.

The basic principle of the releasing operation of this holding device is that the hook body which is seated on the baseplate, and thereby covers the latter completely, is displaced in order in this way to give free access to the adhesive strip.

For this purpose, the hook body is displaced by a few centimetres in a movement parallel to the baseplate. On account of the extensions provided on the baseplate, which slide in correspondingly shaped guides of the hook body, the hook body is guided along during the movement operation by the underlying surface, at least on one side, so that one of the grip tabs of the adhesive strip is freely accessible. The guides in the hook body are also designed such that no tilting of the upper edge with respect to the underlying surface occurs.

In the preferred embodiment of the baseplate with extensions which are all arranged at the same height, the above problem is precluded from the outset by the design.

Particularly advantageous embodiments of the holding device according to the invention are presented in more detail below with reference to several figures, without wishing to restrict the invention unnecessarily by doing so.

DETAILED DESCRIPTION

Figure 1:
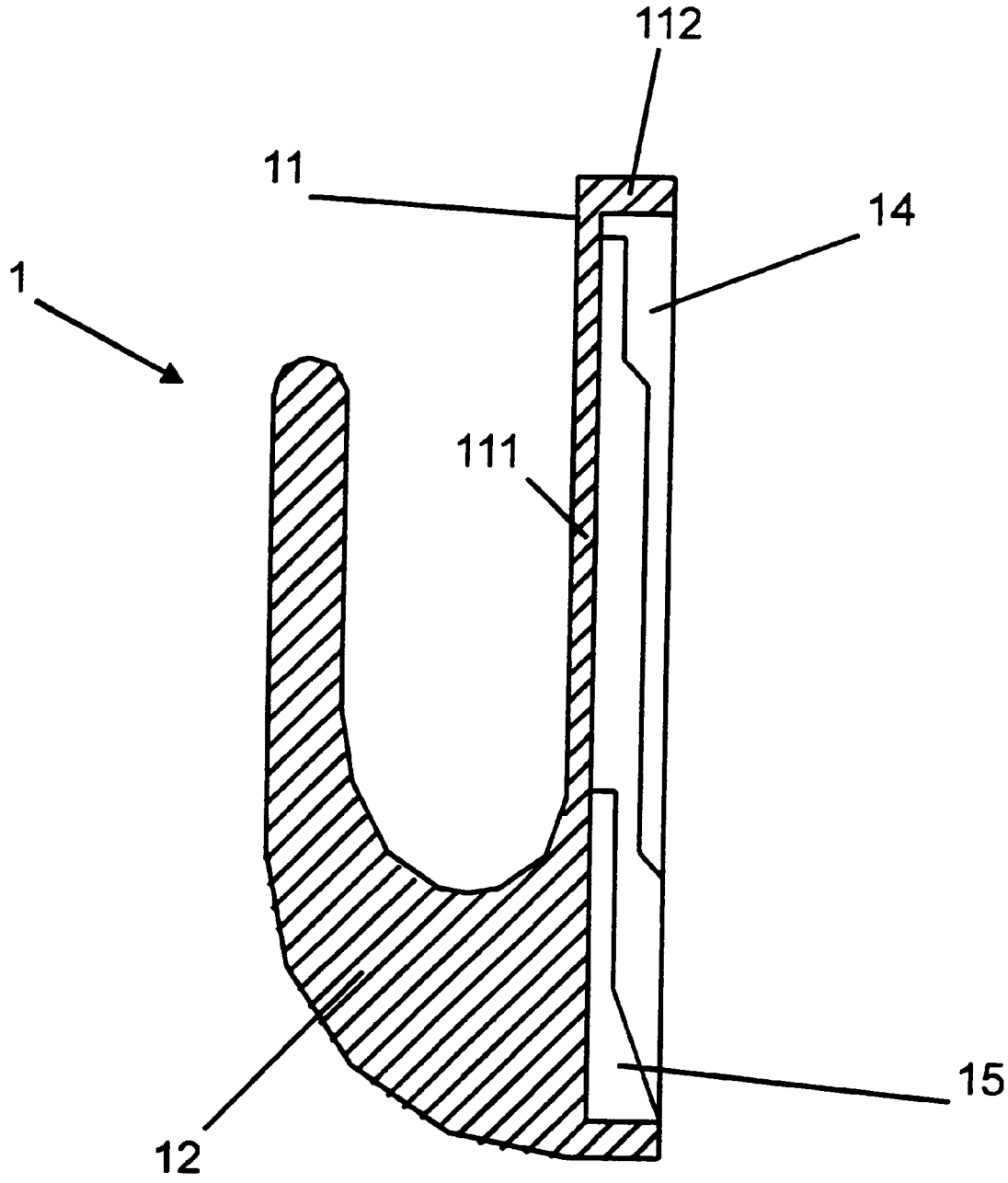
FIG. 1 shows the hook of the holding device in lateral view.

In FIG. 1, the hook body 1 of the holding device is represented in a lateral section. The hook wall 11 of the hook body 1 comprises a preferably rectangularly shaped plate 111, which is completely surrounded by an overhanging border 112. Underneath the plate 111 are a total of four guides (two the same respectively), by means of which the baseplate 2 is guided in the hook body and of which two guides 14, 15 are represented.

The guides 14, 15 are adjacent to the border 112. Furthermore, the guides 14, 15 terminate with the border 112, i.e. the guides 14, 15 do not protrude beyond the outer edge of the border 112. The guide 14 begins at the upper region of the plate 111, is then shaped such that there is formed between guide 14 and plate 111 an intermediate space, which serves for receiving the extension 21 on the baseplate 2. In the third region of the guide 14, the intermediate space between the guide 14 and the plate 111 is enlarged. Finally, the guide 14 extends into the region of the plate 111 in which the guide 15 starts underneath the plate 111. The guide 15 begins at the lower region of the plate 111 and runs directly underneath the plate 111. The height initially decreases continuously, then the guide 15 runs into a portion of constant height. The guide 15 extends to the extent that the guides 14, 15 overlap slightly.

On the hook wall 11, to be precise opposite the border 112, there is integrally formed a hook 12, which serves for receiving any desired items, for example items of clothing, towels etc.

Figure 2:
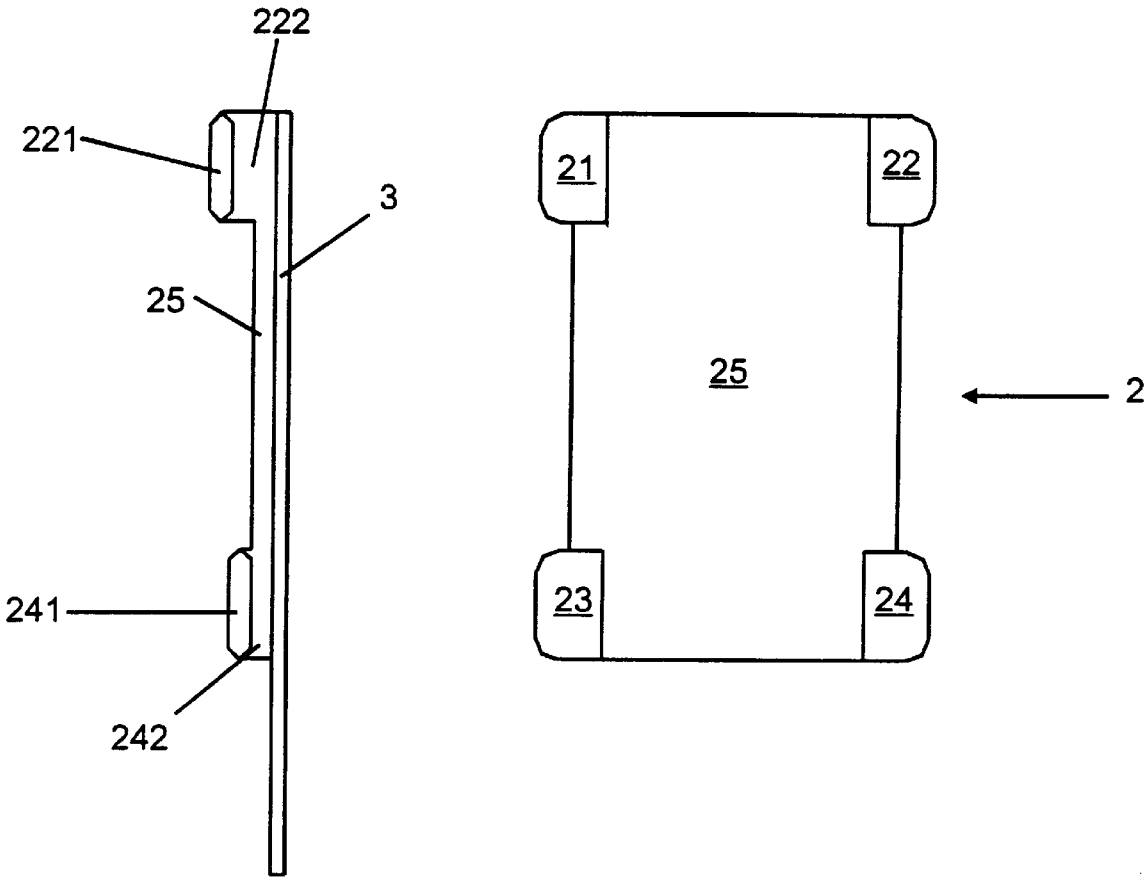
FIG. 2 shows the baseplate of the holding device in plan view and the baseplate bonded to an adhesive strip, the extensions being arranged in pairs at different heights.

FIG. 2 shows the baseplate 2 and the baseplate 2 bonded by means of an adhesive strip 3 in lateral view, the protruding region of the adhesive strip 3 not being provided with adhesive, in other words forming a grip tab for the adhesive strip 3. The baseplate 2 comprises a substantially rectangularly shaped base 25, on which a total of four extensions 21, 22, 23, 24 are integrally formed at the corners. Two of the extensions 21, 22, 23, 24 respectively lie opposite one another. The extension 21 is to be described in more detail by way of example of the others. The extension 21 comprises a top plate 221, which is likewise substantially rectangularly shaped. The outwardly facing edge of the top plate 221 is provided with rounded-off corners. The connection between top plate 221 and base 25 takes place by a support 222, which adjoins on the one hand in the corner region of the base 25 and on the other hand at the inner edge of the top plate 221. As can be seen from the lateral view, the supports 222, 242 have different heights, the heights of the supports 222, 242 of the extensions respectively lying opposite one another, extensions 21 and 22 and extensions 23 and 24, being identical.

Figures 3A, 3B, 3C, 3D:
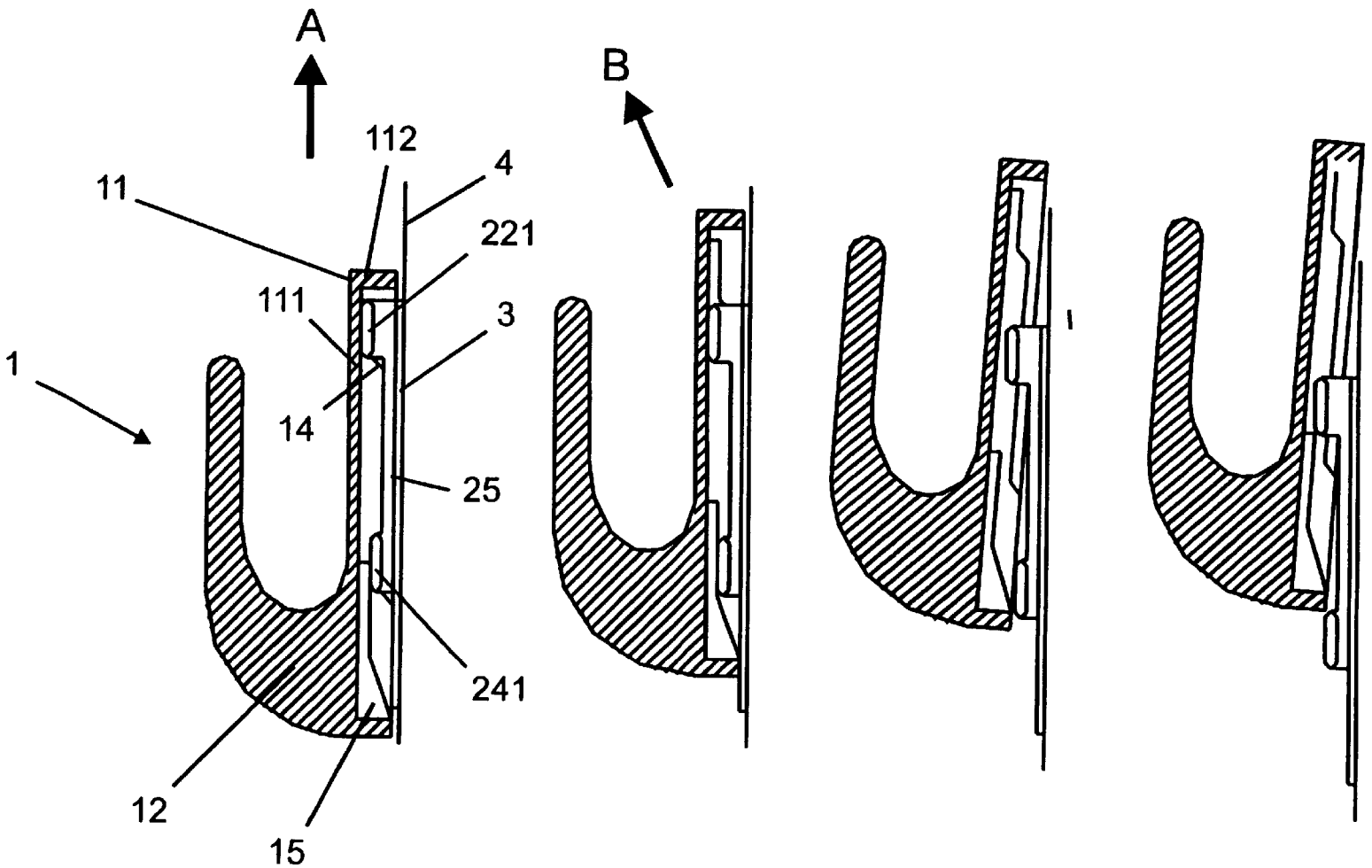
FIGS. 3*a* to 3*d* show the operation of releasing the holding device with the baseplate from FIG. 2, which has been adhesively attached on an underlying surface by means of an adhesive strip.

FIGS. 3*a* to 3*d* show the releasing operation of the holding device, comprising hook body 1 and baseplate 2, which are adhesively attached on an underlying surface 4, for example a tile, by means of the adhesive strip 3. In FIG. 3*a*, the holding device is in the permanently bonded state. For this purpose, the baseplate 2 is fixed by the adhesive strip 3. The hook body 1 has been pushed onto the baseplate 2 in such a way that the extensions 21, 22 are clamped within the border 112 of the hook 1 in the intermediate space between the guide 14 of the hook and the plate 111. At the same time, the extensions 23, 24 rest on the second guide 15. The adhesive strip 3, together with the grip tab and the baseplate 2, are completely covered by the hook body 1.

For releasing the holding device from the wall, the hook body 1 is pushed vertically upwards, in other words parallel to the bonding plane, as indicated by the arrow A. The extension 21 slides out of the intermediate space between plate 111 and guide 14, at the same time the extension 24 butts against the region of the guide 15 in which the height continuously increases.

During the further displacing of the hook 1, the hook body 1 lifts itself off the underlying surface, as is indicated by the arrow B, in the lower region on account of the shaping of the guide 15.

If the hook body 1 is displaced still further upwards, the grip tab of the adhesive strip 3 becomes freely accessible and can be released from the underlying surface by pulling in the direction of the bonding plane, because the pulling forces lead to a reduction in the adhesive forces. At the same time, however, the adhesive strip 3 is also released from the baseplate 2, so that the holding device is likewise removed from the underlying surface and can be adhesively attached again.

In FIG. 3*d* it is shown that the guides 14, 15 overlap in such a way that the hook body 1 cannot be removed from the baseplate 2, the two parts represent an inseparable unit, loss of one of the two parts is not possible.

Figure 4:
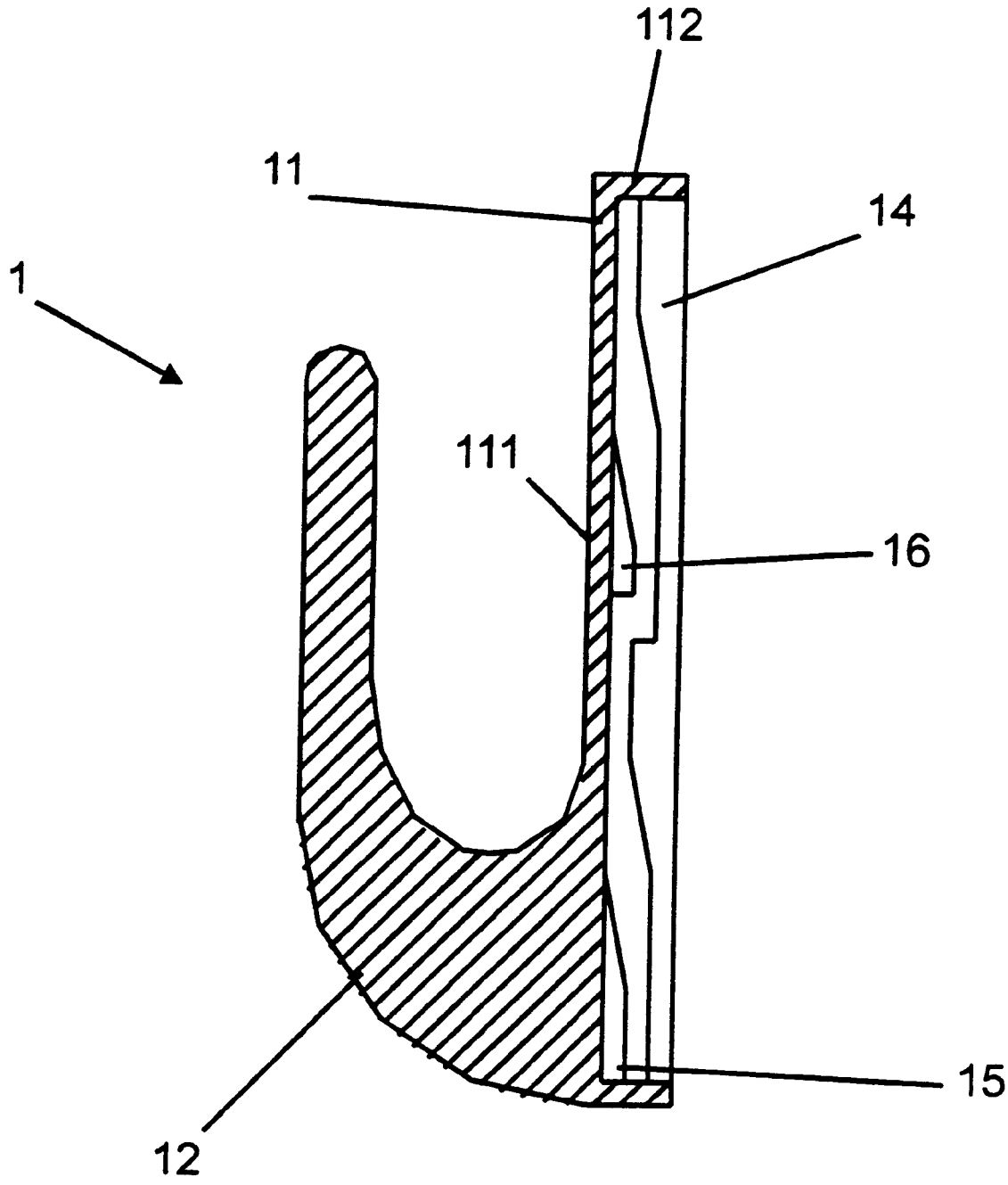
FIG. 4 shows another preferred embodiment of the hook of the holding device in lateral view.

Another preferred embodiment of the hook body 1 is represented in FIG. 4. The hook body 1 shown here differs from the hook body 1 according to FIG. 1 only in the aspects that there is added to the guides 14, 15 underneath the plate 111 a third guide 16, which is shaped in a comparable way to the guide 15 and is located about halfway up the plate 111. On the guide 14 there is a further elevation, approximately mid-way along the hook 1. The different shaping of the guides 14, 15, 16 presupposes that the associated baseplate 2 also has a different design.

Figure 5:
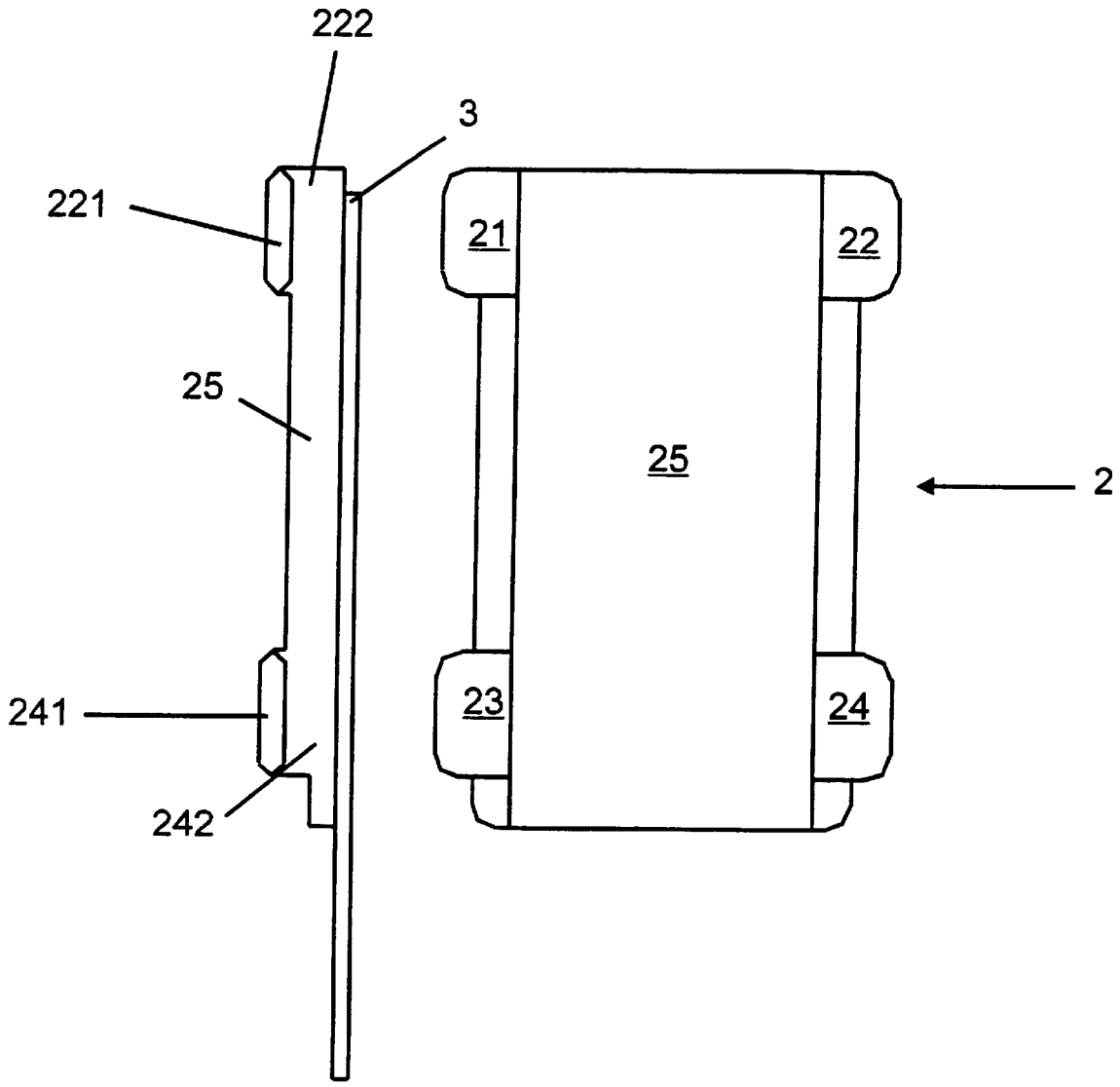
FIG. 5 shows the baseplate of the holding device in plan view and the baseplate bonded to an adhesive strip, the extensions being arranged in pairs at the same height.
Figures 6A, 6B, 6C, 6D:
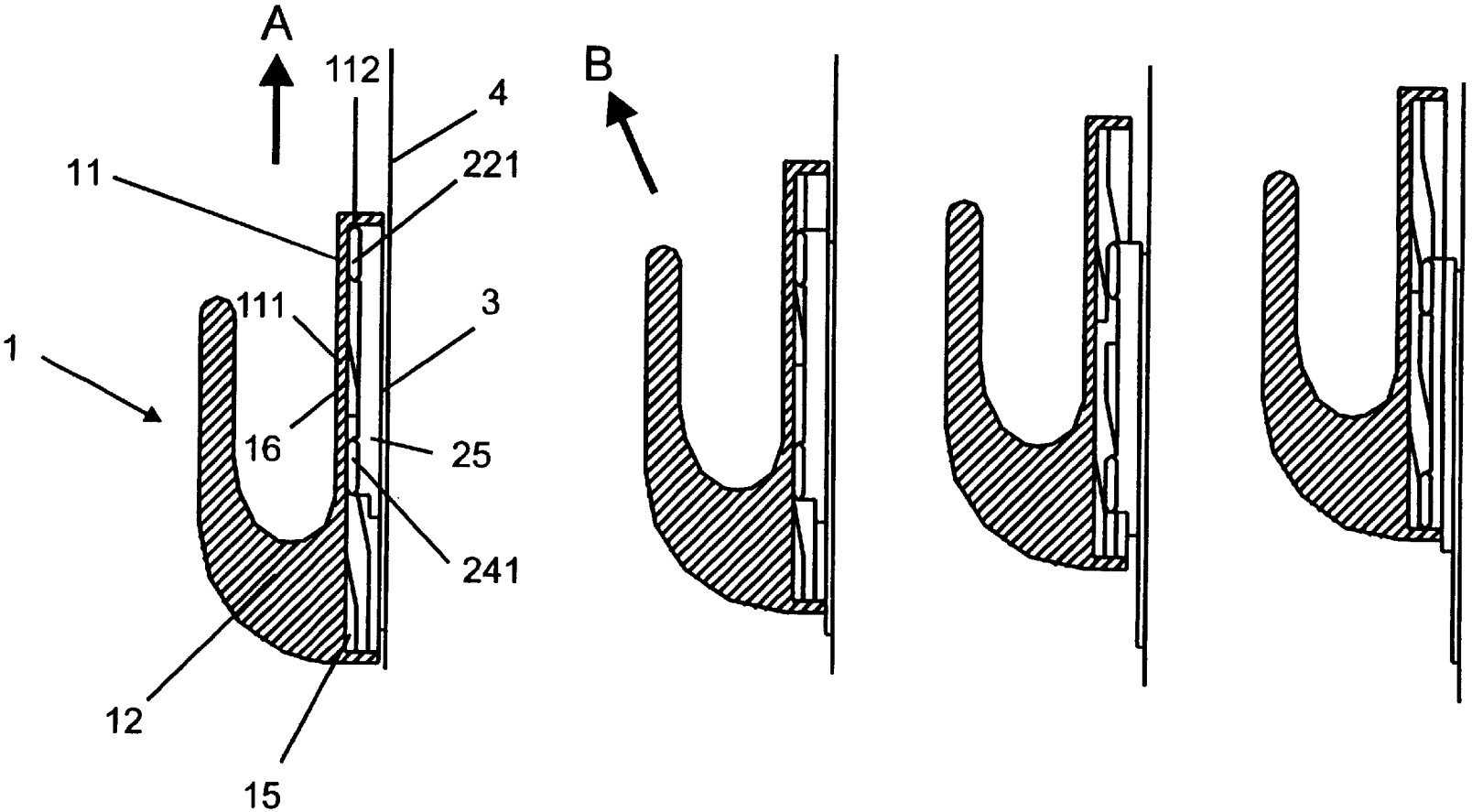
FIGS. 6*a* to 6*d* show the operation of releasing the holding device with the baseplate from FIG. 4, which has been adhesively attached on an underlying surface by means of an adhesive strip.

FIG. 5 shows the baseplate 2, which together with the hook body 1 according to FIG. 4 forms a holding device. In the case of this baseplate 2, all the extensions 21, 22, 23, 24 are arranged at the same height, i.e. the supports 222, 242 have the same dimensions between base 25 and top plates 221, 241.

FIGS. 6*a* to 6*d* disclose the functional principle of the holding devices. The guide 14 with the two elevations forms two intermediate spaces between plate 111 and elevation 14, into which spaces there engage the extensions 22, 24 provided at the same height, so that the hook body 1 is seated firmly on the baseplate 2, bonded by means of the adhesive strip 3. When the hook 1 is displaced in the vertical direction, in other words parallel to the bonding plane, (see arrow A), after a short distance the extensions 22, 24 butt against the guides 15, 16, which has the consequence that, if the hook body 1 is moved further, the hook body 1 lifts itself off the underlying surface without tilting, which is indicated by the arrow B. The plate 111 is at the same time always aligned parallel to the underlying surface. In the case of this embodiment as well, the hook body 1 cannot be detached from the baseplate 2.

Figure 7:
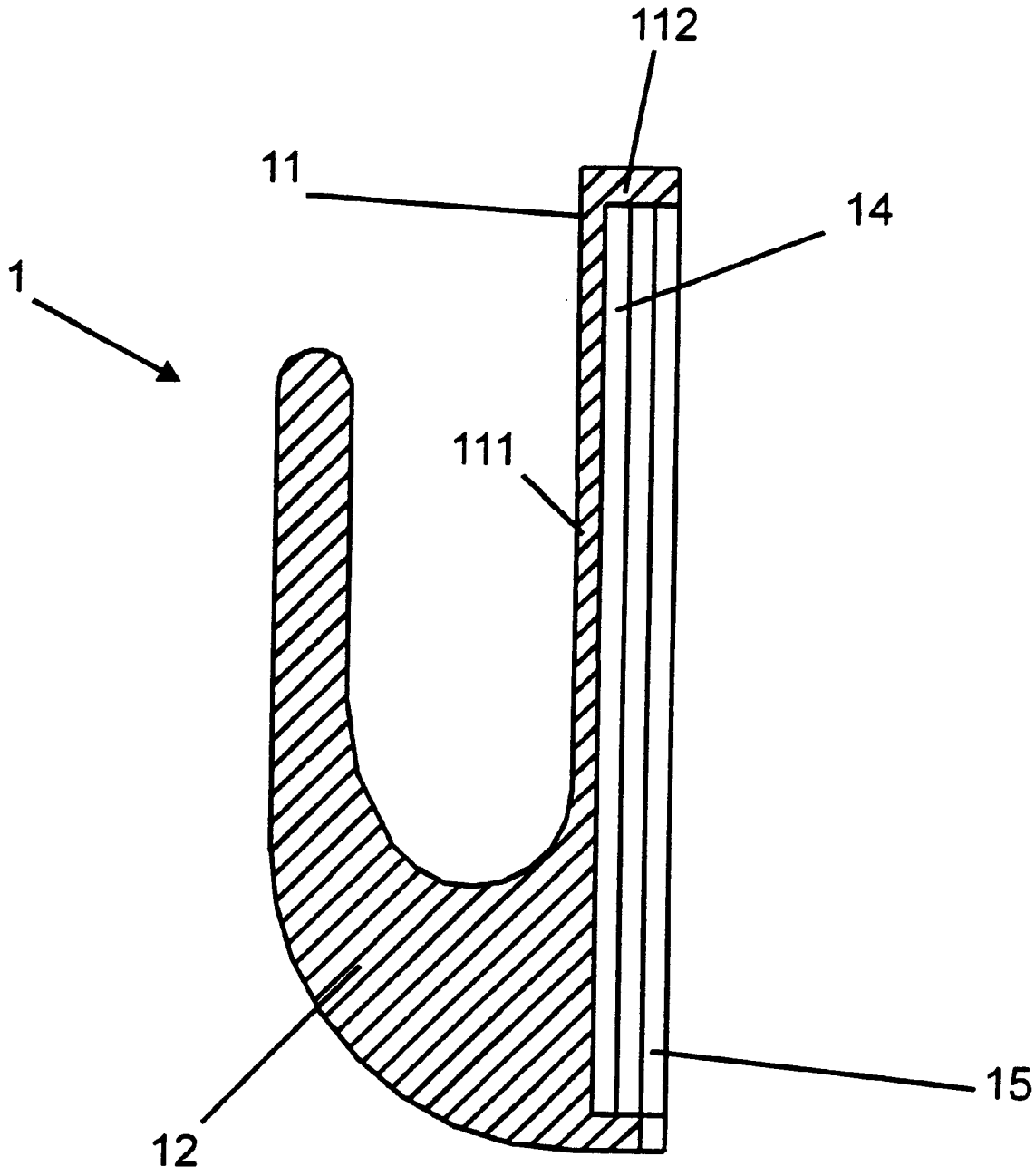
FIG. 7 shows a further preferred embodiment of the hook of the holding device in lateral view.

Another preferred embodiment of the hook body 1 of the holding device is represented in FIG. 7 in lateral section. The hook wall 11 comprises a preferably rectangularly shaped plate 111, which is completely surrounded by an overhanging border 112. Only the lower border 112 has a slightly smaller height than the other portions, to be precise the height is reduced by the thickness of the baseplate 2.

Underneath the plate 111 are a total of four guides (two the same respectively), by means of which the baseplate 2 is guided in the hook body and of which two guides 14, 15 are represented.

The guides 14, 15 are adjacent to the border 112. The guide 14 runs directly underneath the plate 111 and extends over the entire length of the plate 111. The guide 15 likewise extends over the entire length of the plate 111, but begins and ends respectively at the outer edge of the border 112. Between the two guides 14, 15 there is consequently produced an intermediate space, in which the extensions 21, 23 of the baseplate 2 are guided.

On the hook wall 11, to be precise opposite the border 112, there is in turn integrally formed a hook 12, which serves for receiving any desired items, for example items of clothing, towels etc.

Figure 8:
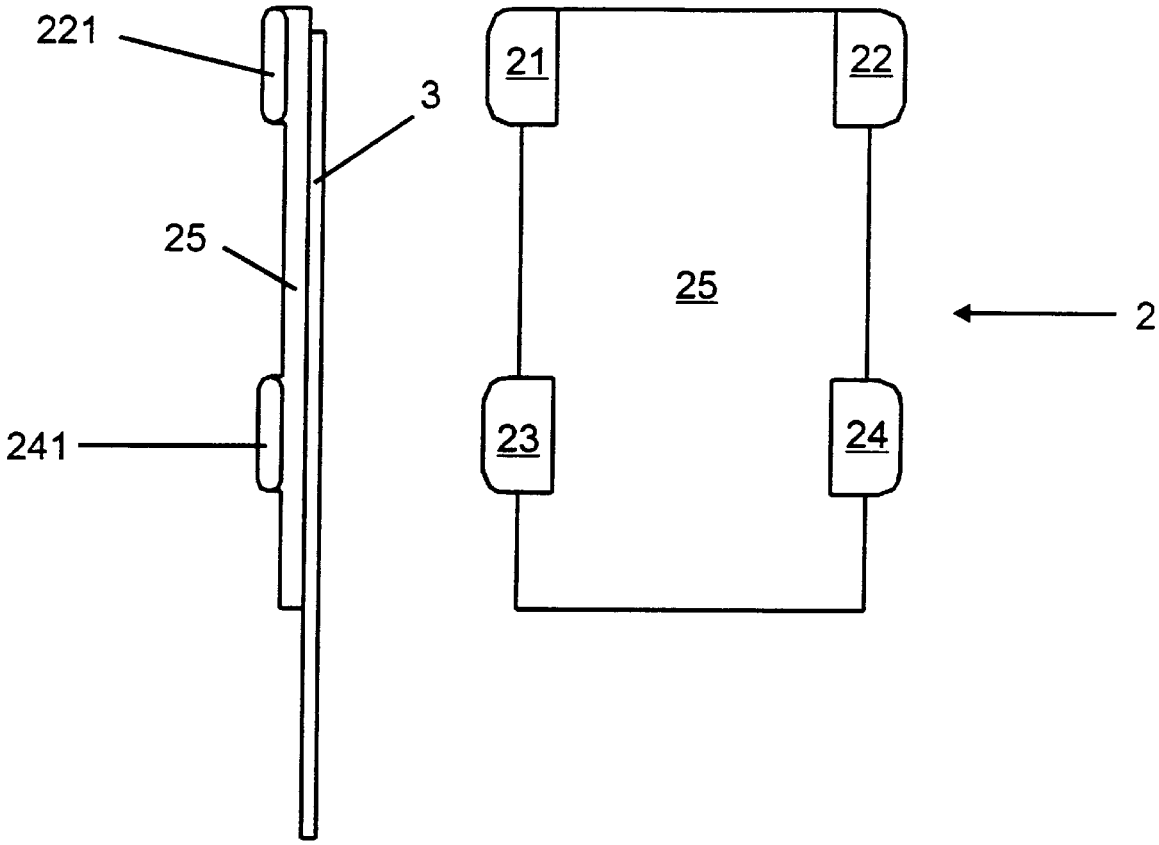
FIG. 8 shows the baseplate of the holding device in plan view and the baseplate bonded to an adhesive strip, the extensions being arranged in pairs at the same height.

FIG. 8 shows the baseplate 2, which together with the hook body 1 according to FIG. 7 forms a holding device. In the case of this baseplate 2, all the extensions 21, 22, 23, 24 are arranged at one height. Unlike in the case of the baseplate 2 from FIG. 5, in the case of this embodiment there are no supports between base 25 and top plates 221, 241, i.e. the top plates 221, 241 are directly on the base 25. Furthermore, the lower extensions 23, 24 are not in the corner region of the base 25, instead the extensions have been displaced a little towards the middle of the base 25.

Figure 9A:
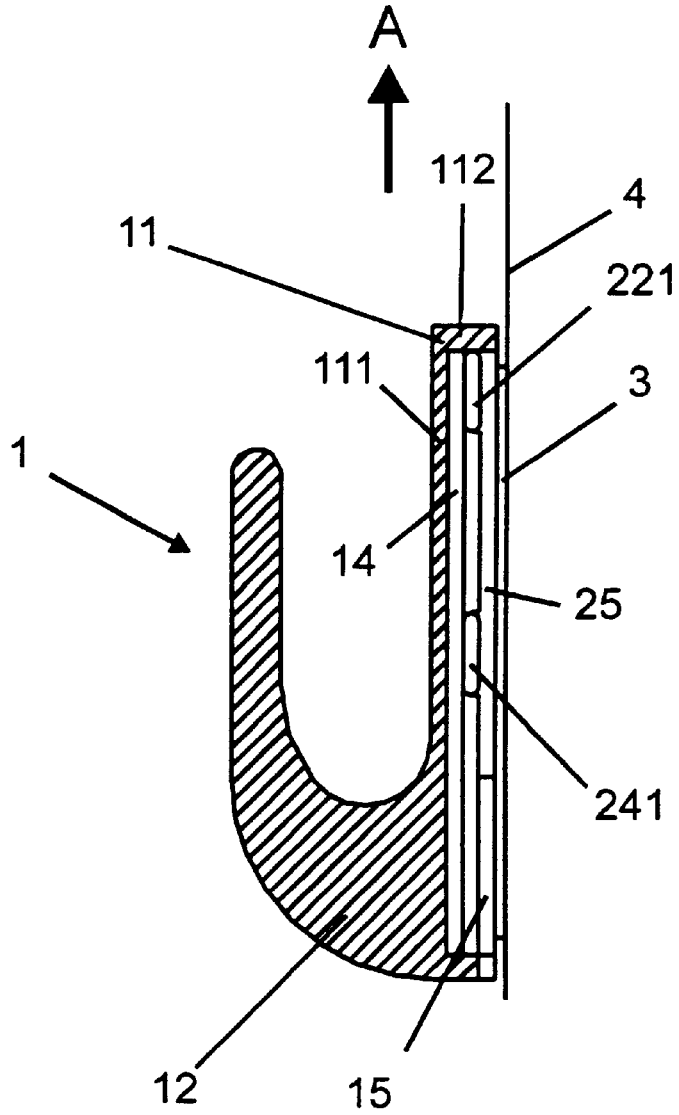
FIGS. 9*a* and 9*b* show the operation of releasing the holding device with the baseplate from FIG. 4, which has been adhesively attached on an underlying surface by means of an adhesive strip.
Figure 9B:
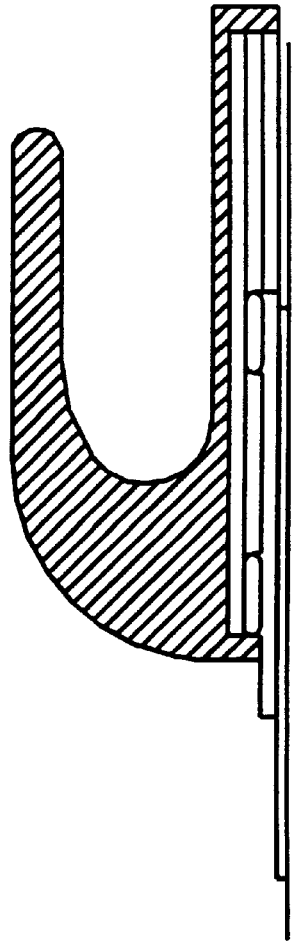

FIGS. 9*a* and 9*b* disclose the functional principle of this holding device. The extensions 21, 23 engage in the intermediate space between the guides 14, 15 and are guided there. Due to gravity, the hook body 1 is in the basic position. The baseplate 2 bonded by means of the adhesive strip 3 is butting against the upper border 112 of the hook body. In order to release the holding device, the hook body 1 must be moved in the direction of arrow A. The extensions 21, 23 then slide in the intermediate space between the guides 14, 15. The displacement of the hook body 1 is possible until the lower border 112 butts against the extension 23. Then, however, the grip tab of the adhesive strip 2 is also freely accessible, the adhesive strip can be pulled off.

What is claimed is:

1. Holding device, comprising a one-part hook body and a one-part baseplate, the baseplate having adhesively attached on its rear surface an adhesive strip which releases on pulling and being designed such that a grip tab of the adhesive strip protrudes beyond the baseplate, the hook body being mounted on the front surface of the base plate and designed such that it covers over the baseplate and protruding grip tab, wherein a) on the baseplate there are integrally formed at least four extensions, which b) respectively lie opposite one another in pairs and which c) protrude laterally beyond the baseplate, and wherein in the hook body there are formed guides in which the extensions of the baseplate are guided such that a) the hook body is released by a movement parallel to the baseplate from the basic position, in which the hook body is anchored on the baseplate and thereby covers over the baseplate and the grip tab of the adhesive strip, and during this release lifts itself off the underlying surface, at least on one side, so that b) access to the grip tab is possible, and c) the hook body and the baseplate are undetachably bonded to each other.

2. Holding device according to claim 1, wherein the extensions are arranged at the same height.

3. Holding device according to claim 1, wherein the hook body is always aligned parallel to the baseplate during the movement parallel to the baseplate.

4. Holding device according to claim 1, wherein the hook body, the baseplate or both are produced from metal or plastic.

5. Holding device according to claim 1, wherein the hook body has a border which laterally encloses and visually conceals the baseplate and the adhesive strip to be adhesively attached behind the latter.

6. Holding device of claim 4, wherein said plastic is polyethylene terephthalate, polystyrene or acrylonitrile-butadiene-styrene.

* * * * *